US010001742B2

(12) United States Patent
Kashimoto

(10) Patent No.: US 10,001,742 B2
(45) Date of Patent: Jun. 19, 2018

(54) TRANSMISSION MEMBER OF PHOTOCONDUCTOR DRUM FOR IMAGE FORMING APPARATUS

(71) Applicant: KYOCERA Document Solutions Inc., Osaka-shi, Osaka (JP)

(72) Inventor: Masahiro Kashimoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/622,546

(22) Filed: Jun. 14, 2017

(65) Prior Publication Data

US 2017/0364020 A1 Dec. 21, 2017

(30) Foreign Application Priority Data

Jun. 21, 2016 (JP) ..... 2016-122481

(51) Int. Cl.
*G03G 15/00* (2006.01)

(52) U.S. Cl.
CPC ..... *G03G 15/757* (2013.01)

(58) Field of Classification Search
CPC ..... G03G 15/757
USPC ..... 399/167
See application file for complete search history.

(56) References Cited

U.S. PATENT DOCUMENTS

2004/0152001 A1* 8/2004 Iizuka ..... G03G 5/10 430/69
2009/0180795 A1* 7/2009 Karasawa ..... G03G 15/0225 399/100

FOREIGN PATENT DOCUMENTS

JP 2000089608 A 3/2000

* cited by examiner

*Primary Examiner* — Sandra Brase
(74) *Attorney, Agent, or Firm* — Alleman Hall Creasman & Tuttle LLP

(57) ABSTRACT

An image forming apparatus includes a transfer belt, a photoconductor drum, and a transmission member. The transfer belt includes a transfer surface. The photoconductor drum faces the transfer surface of the transfer belt in an attachment state where the photoconductor drum is attached to an apparatus main body. The transmission member is attached to a drum end of the photoconductor drum on the insertion direction side and transmits an input rotational driving force to the photoconductor drum. The transmission member includes a flange and a gear. The flange is larger than the photoconductor drum in outer diameter. The gear projects from the flange in the insertion direction with teeth being formed on an outer circumferential surface of the gear, the teeth receiving the rotational driving force. The gear is larger than the photoconductor drum and smaller than the flange in outer diameter.

7 Claims, 5 Drawing Sheets

TRANSMISSION MEMBER OF PHOTOCONDUCTOR DRUM FOR IMAGE FORMING APPARATUS

INCORPORATION BY REFERENCE

This application is based upon and claims the benefit of priority from the corresponding Japanese Patent Application No. 2016-122481 filed on Jun. 21, 2016, the entire contents of which are incorporated herein by reference.

BACKGROUND

The present disclosure relates to an image forming apparatus that includes a photoconductor drum.

An electrophotographic image forming apparatus includes a photoconductor drum on which a toner image is formed by a developing device. The toner image formed on the photoconductor drum is primary-transferred to a transfer belt by a transfer device while the photoconductor drum is rotating, and then secondary-transferred to a print sheet. In this type of image forming apparatus, a transmission member is provided on an end portion of the photoconductor drum at one of opposite ends opposing to each other in the longitudinal direction, a rotational driving force is input to a gear that is integrally formed with the transmission member, and the rotational driving force is transmitted to the photoconductor drum and causes the photoconductor drum to rotate. Conventionally, there is known an image forming apparatus that includes, as the transmission member, a flange and a gear, wherein the flange comes into contact with the end portion of the photoconductor drum, and the gear has a projection portion that projects from the flange outward in the axial direction, wherein teeth are formed on the outer circumferential surface of the projection portion.

SUMMARY

An image forming apparatus according to an aspect of the present disclosure includes a transfer belt, a photoconductor drum, and a transmission member. The transfer belt is provided in an apparatus main body. The transfer belt includes a transfer surface on which a toner image is transferred. The photoconductor drum can be inserted in and pulled out from the apparatus main body. The photoconductor drum is formed in a cylindrical shape with its axial direction being identical with an insertion direction in which the photoconductor drum is inserted in the apparatus main body. The photoconductor drum faces the transfer surface of the transfer belt in an attachment state where the photoconductor drum is attached to the apparatus main body. The transmission member is attached to a drum end of the photoconductor drum on the insertion direction side and transmits an input rotational driving force to the photoconductor drum. The transmission member includes a flange and a gear. The flange is larger than the photoconductor drum in outer diameter. The gear projects from the flange in the insertion direction with teeth being formed on an outer circumferential surface of the gear, the teeth receiving the rotational driving force. The gear is larger than the photoconductor drum and smaller than the flange in outer diameter.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
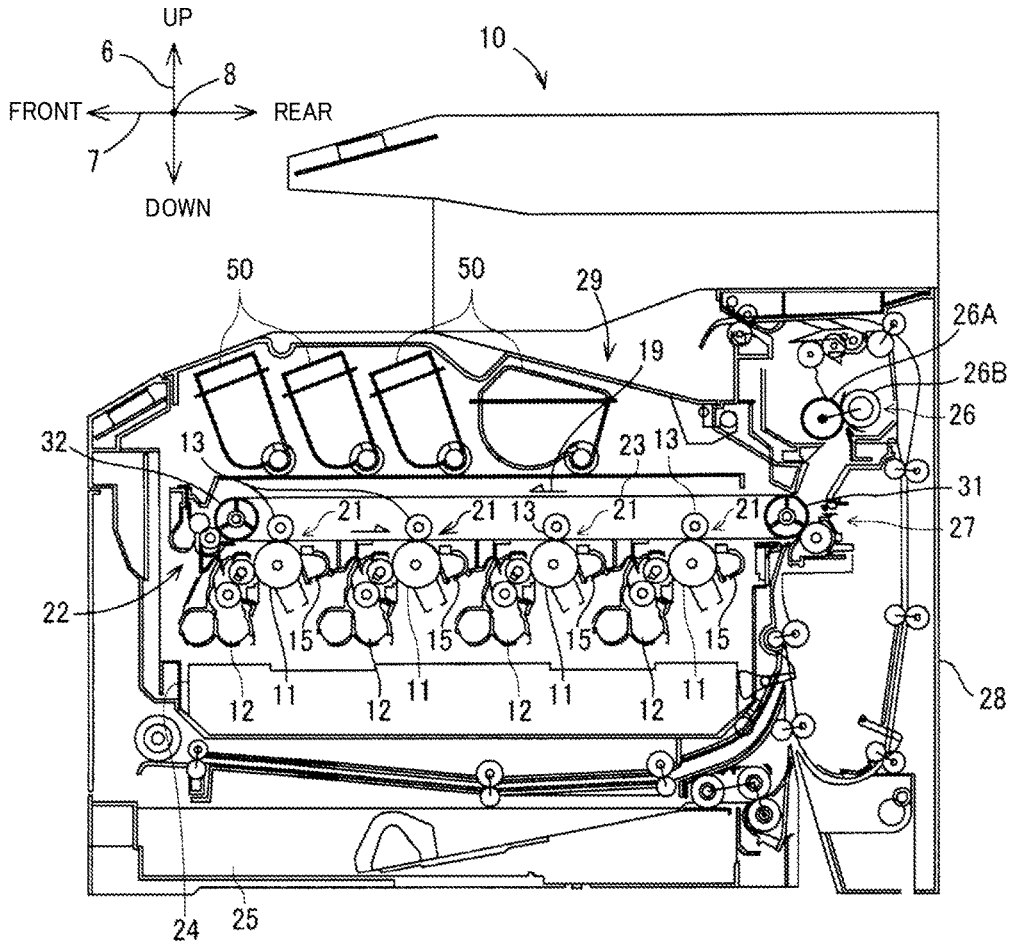
FIG. 1 is a diagram showing a configuration of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. In addition, in the following description, an up-down direction 6 is defined based on a state where an image forming apparatus 10 is installed on a flat support surface (the state shown in FIG. 1). In addition, a front-rear direction 7 is defined on a basis that the left side in FIG. 1 is a front side of the image forming apparatus 10. Furthermore, a left-right direction 8 (a direction perpendicular to the plane of FIG. 1) is defined based on the image forming apparatus 10 of FIG. 1 viewed from the front side. As a result, the front side with respect to the plane of FIG. 1 is the right side of the image forming apparatus 10 and the depth side is the left side of the image forming apparatus 10.

The image forming apparatus 10 has at least a print function. As shown in FIG. 1, the image forming apparatus 10 is a color printer of a so-called tandem type. The image forming apparatus 10 prints an image on a print sheet by using developer containing toner. It is noted that the image forming apparatus 10 is not limited to such a printer, but may be any apparatus having the print function such as a facsimile apparatus, a copier, or a multifunction peripheral having a plurality of functions including the print function.

As shown in FIG. 1, the image forming apparatus 10 includes, as major components, four image forming portions 21, an intermediate transfer unit 22, a sheet feed cassette 25, a fixing device 26, a secondary transfer device 27, a laser scanning device 24, and four toner containers 50. These components are provided in an apparatus main body 28 that is a housing constituting an external frame (not shown) and an internal frame (not shown) of the image forming apparatus 10.

The four image forming portions 21 are provided below the intermediate transfer unit 22 in the apparatus main body 28. The image forming portions 21 perform an image forming process of forming an image on a print sheet based on a so-called electrophotographic system. Specifically, each of the image forming portions 21 prints an image on a print sheet based on image data that is input from outside via a network communication portion (not shown). Each of the image forming portions 21 includes a photoconductor drum 11, a charging device 14, a developing device 12, a primary transfer device 13, and a cleaning device 15.

The photoconductor drum 11 carries a toner image that is to be transferred to a print sheet. The photoconductor drum 11 is disposed to face a transfer surface of a transfer belt 23 of the intermediate transfer unit 22. The photoconductor drum 11 is caused to carry the toner image by the developing device 12 during the image forming process. The photoconductor drum 11 is rotationally driven and carries the toner image that corresponds to an electrostatic latent image formed on its circumferential surface. The photoconductor drum 11 is formed in a cylindrical shape, and is made by forming a thin layer of a material including amorphous silicon (a-Si) on the surface of a blank pipe made of aluminum.

The intermediate transfer unit 22 is provided above the image forming portions 21 in the apparatus main body 28. A driving pulley 31 and a driven pulley 32 are respectively provided at opposite ends of the intermediate transfer unit 22 opposing in the front-rear direction 7. The intermediate transfer unit 22 includes the transfer belt 23. The transfer belt 23 is suspended between and supported by the driving pulley 31 and the driven pulley 32. This allows the belt surface (transfer surface) of the transfer belt 23 to extend horizontally in the front-rear direction 7. The transfer belt 23 can move in a direction indicated by the arrow 19 while the surface thereof is in contact with the surfaces of the photoconductor drums 11. Toner images are transferred from the photoconductor drums 11 to the surface of the transfer belt 23, and carried thereon.

The secondary transfer device 27 transfers, from the transfer belt 23 to a print sheet, a color toner image formed from toner images of a plurality of colors. The print sheet to which the color toner image has been transferred is conveyed to the fixing device 26. The fixing device 26 fixes the color toner image transferred to the print sheet, to the print sheet by heating. The fixing device 26 includes a heating roller 26A that is heated to a high temperature, and a pressure roller 26B disposed to face the heating roller 26A. In the fixing device 26, the print sheet is conveyed while being nipped by a predetermined biasing force at a nip portion between the heating roller 26A and the pressure roller 26B. This allows the color toner image to be fused and adhered to the print sheet. Subsequently, the print sheet is discharged onto a sheet discharge tray 29 provided on an upper part of the apparatus main body 28.

The four toner containers 50 are provided above the intermediate transfer unit 22. Inside the apparatus main body 28, the four toner containers 50 are aligned in a row along the transfer belt 23 in the front-rear direction 7. The toner containers 50 are configured to supply toner of corresponding colors to the developing devices 12 respectively.

The laser scanning device 24 is provided below the image forming portions 21, more specifically, between the image forming portions 21 and the sheet feed cassette 25. The laser scanning device 24 includes a laser light source that emits a laser beam for respective colors, a polygon mirror as the scanning member for scanning the laser beam, a motor for rotationally driving the polygon mirror, and a mirror that irradiates the scanned laser beam. The laser scanning device 24 irradiates the laser beam to the photoconductor drums 11 of the image forming portions 21 based on the input image data of the respective colors. This allows an electrostatic latent image to be formed on each of the photoconductor drums 11.

Figure 2:
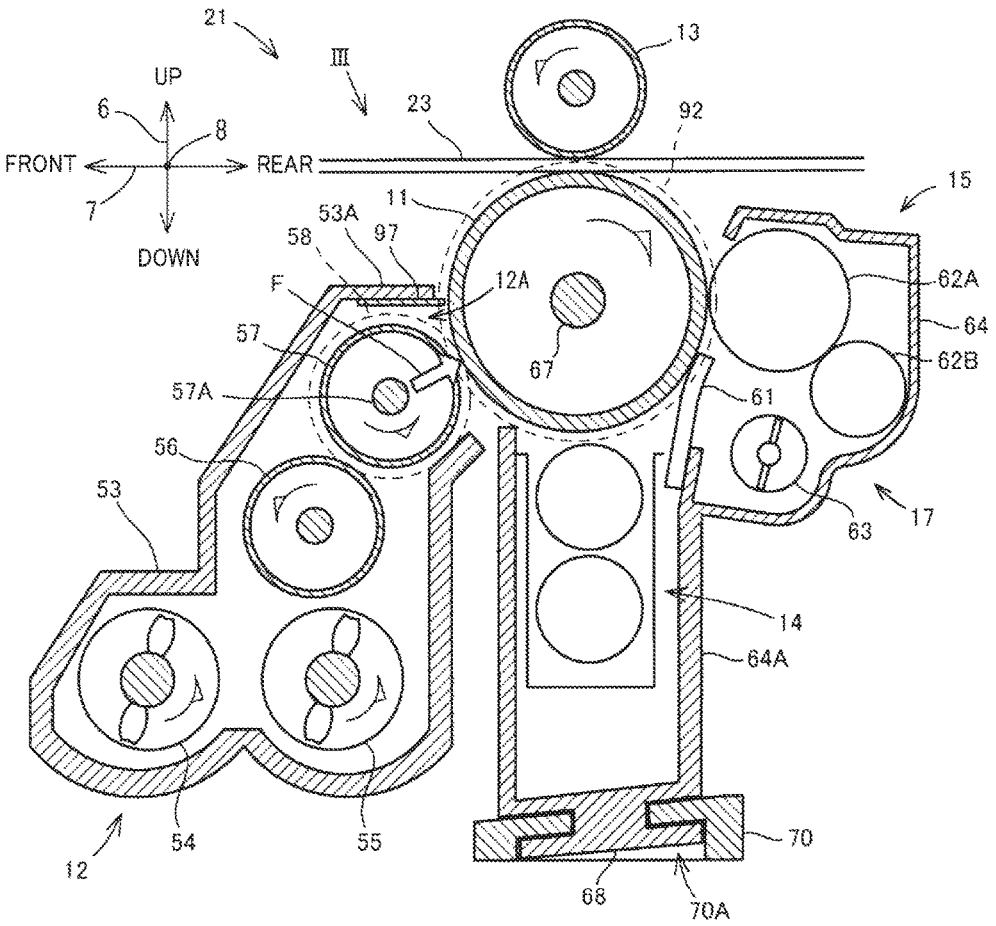
FIG. 2 is a cross-sectional diagram showing a configuration of an image forming portion included in the image forming apparatus.

FIG. 2 is a cross-sectional diagram showing the configuration of the image forming portion 21. The developing device 12 develops the electrostatic latent image with toner based on a developing system in which toner is electrostatically adhered to the photoconductor drum 11 in a non-contact state. As shown in FIG. 2, the developing device 12 includes a housing 53, a first stirring screw 54, a second stirring screw 55, a magnetic roller 56, a developing roller 57, and a rotatable roll 58. Two-component developer containing toner is stored in a bottom portion of the housing 53, and the developer is conveyed while stirred by the first stirring screw 54 and the second stirring screw 55. The magnetic roller 56 draws up, by a magnet embedded therein, the developer from the second stirring screw 55, and causes only the toner included in the developer to be adhered to the surface of the developing roller 57. The developing roller 57 is disposed away from the circumferential surface of the photoconductor drum 11 by a predetermined interval. The toner held on the developing roller 57 is adhered to the electrostatic latent image on the photoconductor drum 11 by the potential difference applied to between the developing roller 57 and the photoconductor drum 11.

Figure 3:
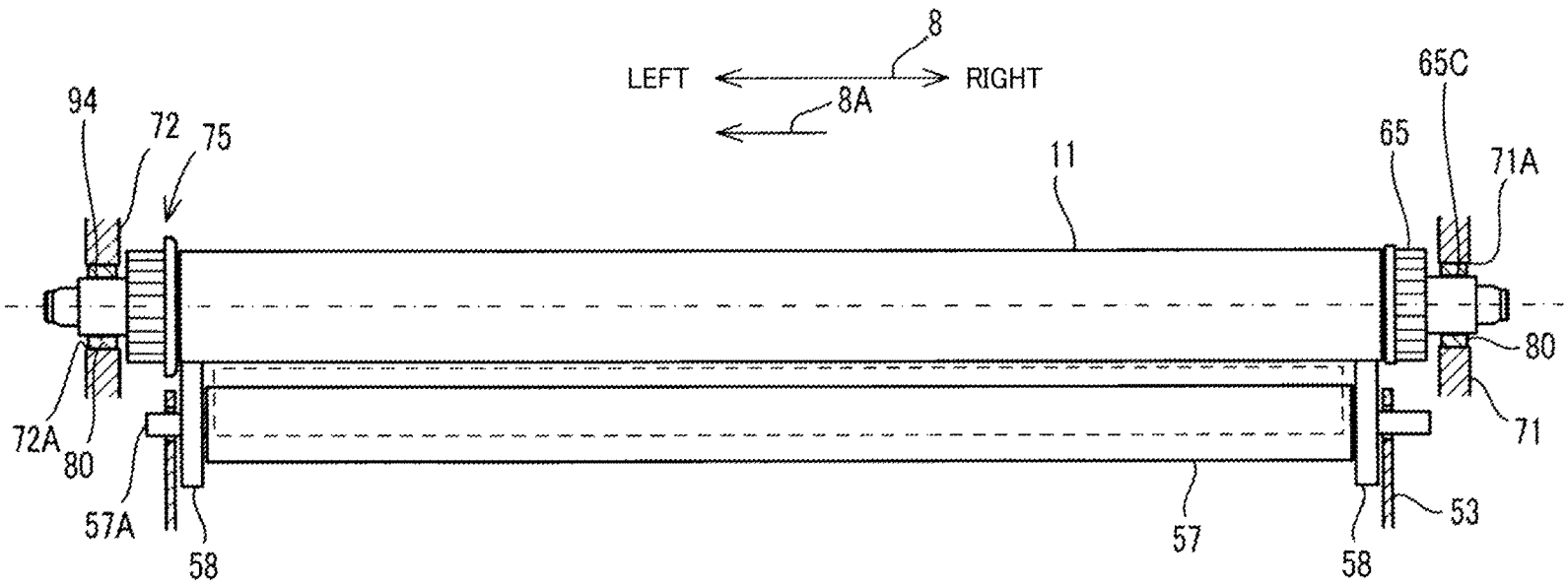
FIG. 3 is a diagram showing a support configuration of a photoconductor drum and a developing roller when viewed from a direction indicated by an arrow III of FIG. 2.

As shown in FIG. 3, two rotatable rolls 58 are respectively provided at opposite ends of a rotation shaft 57A of the developing roller 57, the ends opposing to each other in an axial direction of the rotation shaft 57A. The rotatable rolls 58 are axially supported by the rotation shaft 57A in a state of pressing opposite end portions of the outer circumferential surface of the photoconductor drum 11 with a predetermined biasing force F (see FIG. 2). The rotatable roll 58 is larger than the developing roller 57 in radius. Specifically, the rotatable roll 58 is larger than the developing roller 57 in radius by a length that is equal to the interval between the developing roller 57 and the photoconductor drum 11. As a result, when the rotatable rolls 58 contact the opposite ends of the photoconductor drum 11, the developing roller 57 is positioned away from the photoconductor drum 11 by the predetermined interval. It is noted that, as a configuration allowing for the rotatable rolls 58 to apply the biasing force F to the photoconductor drum 11, an elastic member such as a spring may be used to bias the opposite ends of the rotation shaft 57A toward the center of the photoconductor drum 11.

It is noted that, when a drum unit 17 described below is pulled out from the apparatus main body 28, the developing roller 57 is made apart from the photoconductor drum 11 by a conventionally known separation mechanism (not shown) so that the drum unit 17 can be pulled out easily from the apparatus main body 28.

As shown in FIG. 2, the cleaning device 15 is configured to remove toner that has remained on the photoconductor drum 11. The cleaning device 15 is disposed on the rear side of the photoconductor drum 11. The cleaning device 15 is provided for each photoconductor drum 11. The cleaning device 15 includes a cleaning blade 61 that is a cleaning member, a cleaning roller 62A, a collection roller 62B, a screw member 63, and a housing 64. The cleaning blade 61, the cleaning roller 62A, and the collection roller 62B are supported by the housing 64. The cleaning blade 61, the cleaning roller 62A, and the collection roller 62B have approximately the same length as the photoconductor drum 11. The forward end of the cleaning blade 61 is disposed to be in contact with or close to the surface of the photoconductor drum 11.

The cleaning roller 62A and the collection roller 62B are rotatably supported in the housing 64. Upon input of a rotational driving force to a support shaft of the cleaning roller 62A, the cleaning roller 62A rotates. With the rotation of the photoconductor drum 11, the cleaning blade 61 removes the toner that has remained on the surface of the photoconductor drum 11 after the transfer by the primary transfer device 13. The removed toner (hereinafter referred to as "waste toner") moves to the bottom portion of the housing 64 by the action of gravity or by the rotation of the cleaning roller 62A. The waste toner that has moved to the bottom portion of the housing 64 is conveyed by the rotating screw member 63. A discharge port (not shown) is formed in a side wall of the right end portion of the housing 64. The waste toner is discharged to outside through the discharge port. It is noted that the waste toner that has adhered to the surface of the cleaning roller 62A is scraped off by the collection roller 62B.

In the present embodiment, the photoconductor drum 11 is supported by the housing 64, and the cleaning device 15 and the photoconductor drum 11 are integrally configured. In other words, in a configuration where components of the photoconductor drum 11 and the cleaning device 15 are attached to the housing 64, the photoconductor drum 11 and the cleaning device 15 are unitized as the drum unit 17.

As shown in FIG. 2, the charging device 14 is provided in a storage portion 64A that is a lower portion of the housing 64. In addition, the housing 64 is attached to a support frame 70 provided in the image forming portion 21, in a detachable manner. Specifically, the bottom portion of the storage portion 64A of the housing 64 has a rail 68 that is slidably supported by the support frame 70. In addition, the support frame 70 is provided in the apparatus main body 28, and has a rail guide 70A in which the rail 68 is inserted. When the drum unit 17 is inserted in the apparatus main body 28 leftward (toward the depth side with respect to the plane of FIG. 2) from its right side surface to attach the drum unit 17 to the apparatus main body 28, the rail 68 is inserted in the rail guide 70A. In the state where the rail 68 is inserted in the rail guide 70A, the housing 64 is fixed such that it cannot move in the up-down direction 6 and the front-rear direction 7. It is noted that when the drum unit 17 is removed from the apparatus main body 28, the drum unit 17 is pulled out rightward (toward the front side with respect to the plane of FIG. 2), and the drum unit 17 moves rightward. This allows the drum unit 17 to be removed from the right side of the apparatus main body 28.

As shown in FIG. 3, a first transmission gear 65 is provided at an end (a right end portion) of the photoconductor drum 11, the end portion being one of opposite ends of the photoconductor drum 11 opposing in its longitudinal direction. The first transmission gear 65 is fixed to the right end portion of the photoconductor drum 11. Specifically, the first transmission gear 65 is integrally engaged with the photoconductor drum 11 in a state where the first transmission gear 65 is fitted in an inner hole provided in the right end portion of the photoconductor drum 11.

A second transmission gear 75 (an example of the transmission member of the present disclosure) is provided at the other end (a left end portion) of the photoconductor drum 11, the other end being the other of the opposite ends. The second transmission gear 75 is attached to the left end portion (drum end portion) of the photoconductor drum 11 that is on an insertion direction 8A side, wherein the drum unit 17 is inserted in the apparatus main body 28 in the insertion direction 8A so as to be attached thereto. The second transmission gear 75 transmits a rotational driving force input from a drive source (not shown) such as a motor, to the photoconductor drum 11. The second transmission gear 75 is fixed to the left end portion of the photoconductor drum 11. Specifically, the second transmission gear 75 is integrally engaged with the photoconductor drum 11 in a state where the second transmission gear 75 is fitted in an inner hole provided in the left end portion of the photoconductor drum 11.

A shaft hole is formed in each of the first transmission gear 65 and the second transmission gear 75 at the center thereof. A rotation shaft 67 of the photoconductor drum 11 is inserted in the shaft holes of the first transmission gear 65 and the second transmission gear 75. A sliding clearance is provided between the rotation shaft 67 and each of the shaft holes so that the rotation shaft 67 can rotate.

The housing 64 of the drum unit 17 includes support portions 71 and 72 that rotatably support the photoconductor drum 11. The photoconductor drum 11 is supported by the support portions 71 and 72. As shown in FIG. 3, the support portions 71 and 72 are provided respectively at opposite ends of the housing 64 that oppose to each other in the longitudinal direction of the housing 64. A bearing hole 71A is formed in the support portion 71, and a bearing hole 72A is formed in the support portion 72. The shaft portion 65C of the first transmission gear 65 is inserted in the bearing hole 71A, and a shaft portion 94 of the second transmission gear 75 is inserted in the bearing hole 72A. The shaft portion 65C of the first transmission gear 65 is rotatably supported by the bearing hole 71A via a bush member 80. In addition, the shaft portion 94 of the second transmission gear 75 is rotatably supported by the bearing hole 72A via a bush member 80. It is noted that FIG. 3 shows the support portions 71 and 72, but not the whole housing 64.

Meanwhile, during a puffing-out process where the drum unit 17 is pulled out from the apparatus main body 28, a gear portion 93 may contact the transfer surface of the transfer belt 23. If the gear portion 93 contacts the transfer belt 23, stripe marks or damages may be made on the transfer belt 23. The marks or damages may distort the toner image held on the transfer surface. In addition, lubricant is applied to the gear portion 93 to make the drive transmission smooth, but if the gear portion 93 contacts the transfer surface of the transfer belt 23 and the lubricant adheres to the transfer surface, the toner image on the transfer surface is distorted. This adversely impacts the image formation. Such problems may also occur when the developing roller 57 is made apart from the photoconductor drum 11 by the separation mechanism. In the present embodiment, the second transmission gear 75 is configured so that the above-described problems can be solved, as described below.

The following describes the configuration of the second transmission gear 75 in detail, with reference to FIG. 4A to FIG. 5B.

Figure 4A:
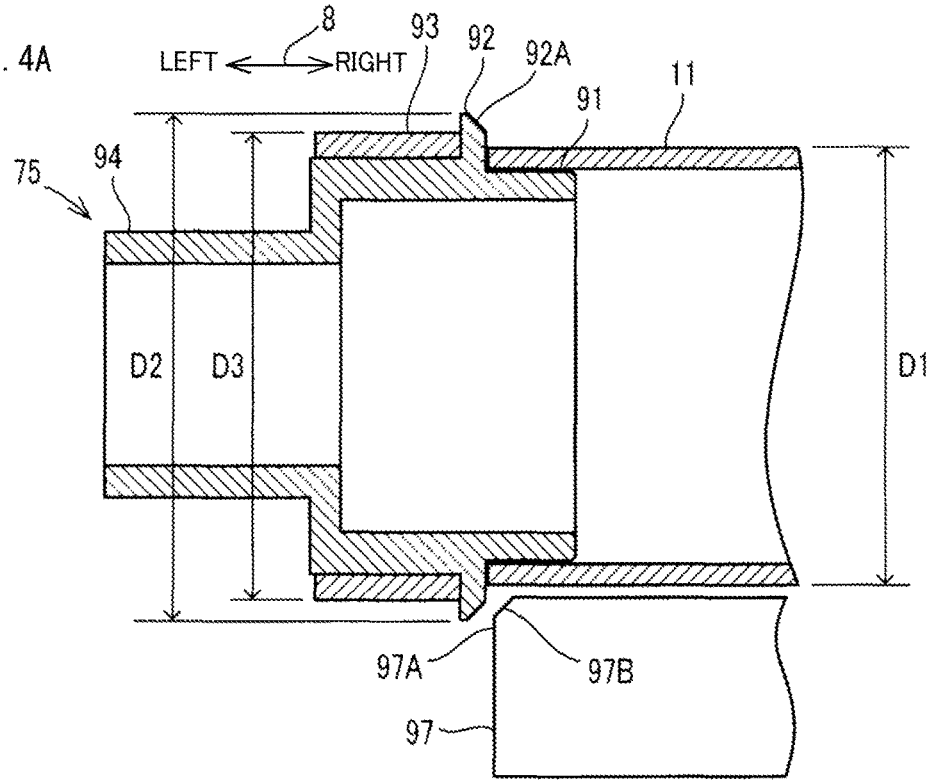
FIG. 4A and FIG. 4B are cross-sectional diagrams showing a configuration of a transmission member provided in an end portion of the photoconductor drum.
Figure 4B:
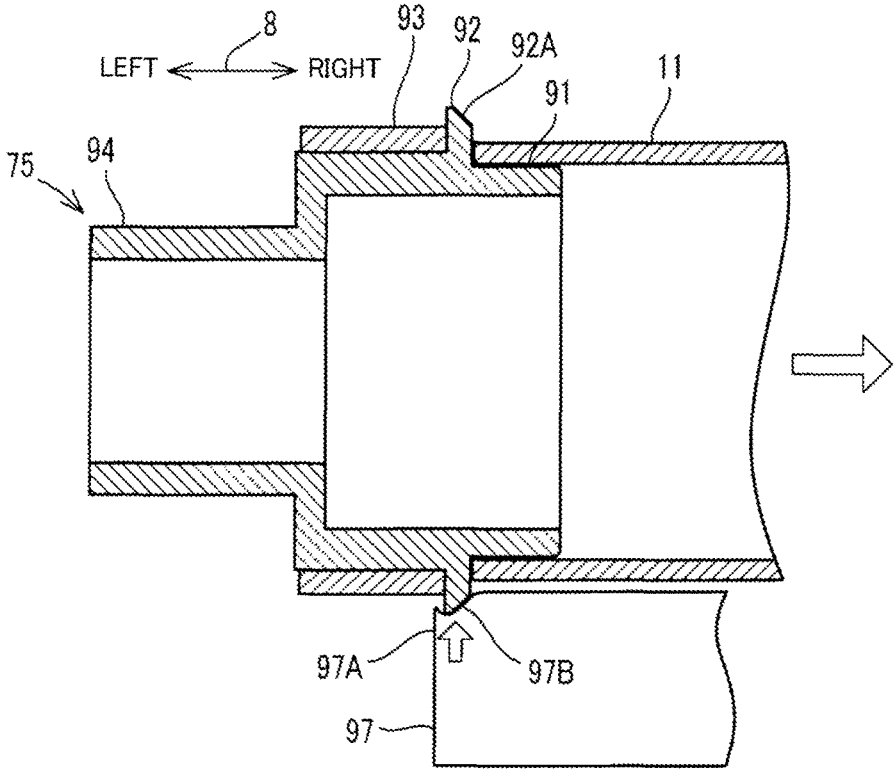

FIG. 4A and FIG. 4B are cross-sectional diagrams showing a cross-sectional structure of the second transmission gear 75, taken along a line segment connecting the rotation shaft 57A of the developing roller 57 and the rotation shaft 67 of the photoconductor drum 11. FIG. 4A is a cross-sectional view in a state (attachment state) where the drum unit 17 is attached to the apparatus main body 28. FIG. 4B is a cross-sectional view in a state where the drum unit 17 has been pulled out slightly from the attachment state. It is noted that in FIG. 4A and FIG. 4B, the housing 64 and the rotation shaft 67 are omitted.

As shown in FIG. 4A, the second transmission gear 75 includes a fitting portion 91, a flange 92 (an example of the flange of the present disclosure), a gear portion 93 (an example of the gear of the present disclosure), and a shaft portion 94.

The fitting portion 91 is configured to be fitted in and fixed to an inner hole of the left end portion of the photoconductor drum 11. The fitting portion 91 is a cylindrical portion projecting from the flange 92 in the axial direction of the photoconductor drum 11. When the fitting portion 91 is fitted in the inner hole of the photoconductor drum 11, the second transmission gear 75 is fixed to the left end portion of the photoconductor drum 11.

The flange 92 is formed on the outer circumferential surface of the photoconductor drum 11, and is an annular projection rib that projects from the outer circumferential surface outward (in a direction of being separated from the rotation shaft 67). The flange 92 has an outer diameter D2 that is larger than an outer diameter D1 of the photoconductor drum 11.

The gear portion 93 is provided so as to project from the flange 92 in the insertion direction 8A. A gear composed of a plurality of teeth is formed on the outer circumferential surface of the gear portion 93, wherein the rotational driving force is input to the teeth. The gear portion 93 is a so-called spur gear with the teeth formed on its outer circumferential surface. An outer diameter D3 of the gear portion 93 is larger than the outer diameter D1 of the photoconductor drum 11, and smaller than the outer diameter D2 of the flange 92.

The shaft portion 94 is a cylindrical member that projects from the gear portion 93 in the insertion direction 8A. The shaft portion 94 is rotatably supported by the bearing hole 72A of the support portion 72 in a state of being inserted therein.

Figure 5A:
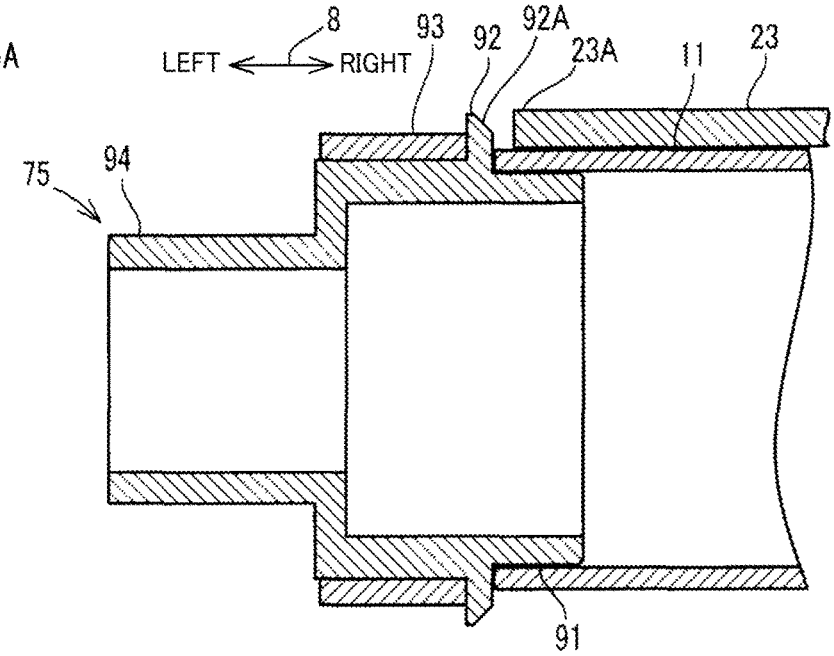
FIG. 5A and FIG. 5B are cross-sectional diagrams showing a configuration of the transmission member provided in the end portion of the photoconductor drum.
Figure 5B:
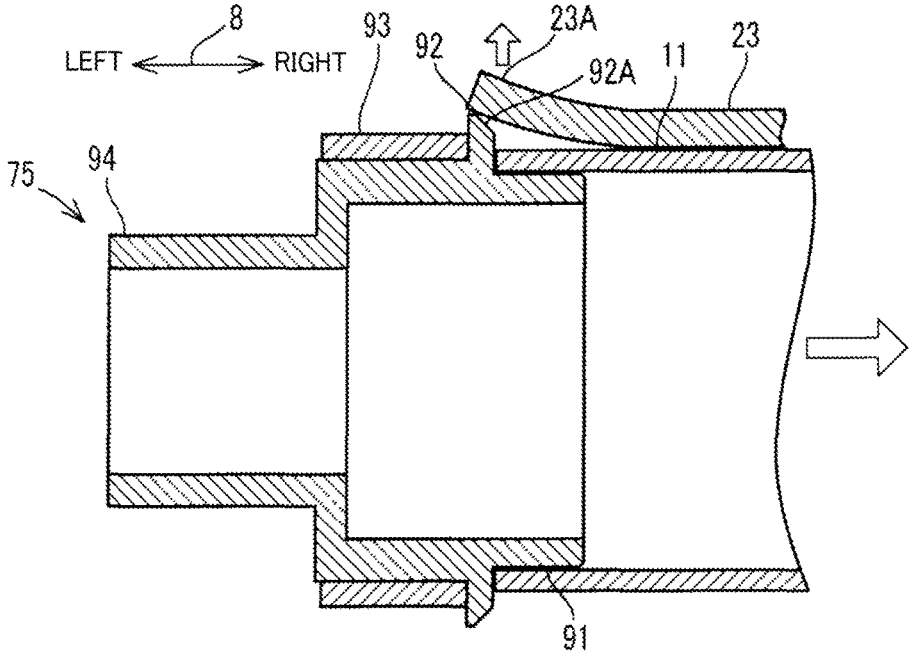

FIG. 5A and FIG. 5B are cross-sectional diagrams showing a cross-sectional structure of the second transmission gear 75, taken along a vertical line that passes through the center of the photoconductor drum 11. FIG. 5A is a cross-sectional view in a state (the attachment state) where the drum unit 17 is attached to the apparatus main body 28. FIG. 5B is a cross-sectional view in a state where the drum unit 17 has been pulled out slightly from the attachment state. It is noted that in FIG. 5A and FIG. 5B, the housing 64 and the rotation shaft 67 are omitted.

As shown in FIG. 5A, in the attachment state, the flange 92 is not in contact with a belt end portion 23A of the transfer belt 23 on the insertion direction 8A side. On the other hand, as shown in FIG. 5B, during the pulling-out process where the drum unit 17 is pulled out from the apparatus main body 28, the flange 92 comes into contact with the belt end portion 23A. As described above, the outer diameter D2 of the flange 92 is larger than the outer diameter D1 of the photoconductor drum 11. As a result, when the drum unit 17 is pulled out slightly, the flange 92 comes into contact with the belt end portion 23A, and when the drum unit 17 is further pulled out, the belt end portion 23A is pressed upward and runs on the top part (the end portion extending in the radius direction) of the flange 92. In this case, since the outer diameter D2 of the flange 92 is larger than the outer diameter D3 of the gear portion 93, the gear portion 93 does not contact the transfer surface of the transfer belt 23. In addition, during the puffing-out process where the drum unit 17 is pulled out from the apparatus main body 28, the flange 92 holds up the transfer belt 23 and the gear portion 93 does not contact the transfer surface of the transfer belt 23.

It is noted that the flange 92 has an inclined surface 92A that is inclined with respect to the belt end portion 23A in the attachment state. Specifically, the inclined surface 92A is formed on the flange 92 at a position that faces the belt end portion 23A in the attachment state. The inclined surface 92A is formed by chamferring a corner portion of the top part of the flange 92. During the pulling-out process where the drum unit 17 is pulled out, the inclined surface 92A smoothly guides the belt end portion 23A to the top part of the flange 92. With this configuration, the load applied to the belt end portion 23A when the flange 92 contacts the belt end portion 23A, is reduced.

In addition, as shown in FIG. 2, a film member 97 (an example of the elastic member of the present disclosure) is provided at a position located more on the transfer belt 23 side than the developing roller 57. An opening 12A is formed in the housing 53 of the developing device 12 such that the developing roller 57 is exposed to the photoconductor drum 11. In the housing 53, an upper wall 53A located above the developing roller 57 extends toward the opening 12A and reaches an edge portion of the opening 12A. In the present embodiment, the film member 97 is fixed to a rear surface of the upper wall 53A (an inner surface of the upper wall 53A) so as to extend from the opening 12A toward the photoconductor drum 11. An extension end of the film member 97 passes over the top part of the flange 92 and reaches a vicinity of the outer circumferential surface of the photoconductor drum 11. It is noted that, as the method for fixing the film member 97, various types of methods such as bonding, screwing, crimping, and welding, are applicable.

With the configuration where the film member 97 extends from the opening 12A toward the photoconductor drum 11, toner floating in a space between the developing roller 57 and the photoconductor drum 11 is prevented from entering the inside of the apparatus main body 28.

The film member 97 is a resin plate member formed from a synthetic resin. A PET resin or the like is used as the synthetic resin. The film member 97 has elasticity, thus it is bent upon receiving an external force, and returns to its original state when the external force is released. The film member 97 is formed in the shape of a rectangle that is elongated in the longitudinal direction of the housing 53 (in a direction perpendicular to the plane of FIG. 2).

As shown in FIG. 4A, the film member 97 is not in contact with the flange 92 of the second transmission gear 75 in the attachment state. On the other hand, as shown in FIG. 4B, during the pulling-out process where the drum unit 17 is pulled out from the apparatus main body 28, the flange 92 comes into contact with a film end portion 97A of the film member 97 located on the insertion direction 8A side. As described above, the extension end of the film member 97 passes over the top part of the flange 92 and reaches a vicinity of the outer circumferential surface of the photoconductor drum 11. As a result, during the pulling-out process where the drum unit 17 is pulled out, the flange 92 comes into contact with the film end portion 97A, and then when the drum unit 17 is further pulled out, the film end portion 97A is bent. At this time, a reaction force created by the bending of the film end portion 97A acts in a direction in which the flange 92 is separated away from the developing roller 57. Accordingly, when the drum unit 17 is pulled out from the apparatus main body 28, the photoconductor drum 11 is hardly inclined toward the developing roller 57. As a result, the flange 92 and the gear portion 93 are prevented from coming into contact with the surface of the developing roller 57.

It is noted that in the film member 97, an inclined portion 97B is formed at a corner of the film end portion 97A on the insertion direction 8A side. The inclined portion 97B comes into contact with the inclined surface 92A of the flange 92 during the pulling-out process where the drum unit 17 is pulled out. With the configuration where, during the pulling-out process, the inclined portion 97B comes into contact with the inclined surface 92A, the film member 97 is easily bent and the load applied to the inclined portion 97B is reduced, and thus the film member 97 is prevented from being broken.

With the above-described configuration of the second transmission gear 75, during the pulling-out process where the drum unit 17 is pulled out from the apparatus main body 28, the gear portion 93 of the second transmission gear 75 is prevented from coming into contact with the transfer surface of the transfer belt 23. As a result, the transfer belt 23 is prevented from being smeared or damaged due to a contact with the gear portion 93.

In addition, due to the above-described configuration of the film member 97, the drum unit 17 is hardly inclined toward the developing roller 57 and the flange 92 and the gear portion 93 do not contact the developing roller 57 during the process where the drum unit 17 is pulled out from the apparatus main body 28. This prevents stripe marks or damages from being made on the surface of the developing roller 57.

It is noted that, although the film member 97 is used an example of the elastic member in the above-described embodiment, an elastic member such as a sponge member or a rubber member may be used instead of the film member 97.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a transfer belt provided in an apparatus main body and including a transfer surface on which a toner image is transferred;

a photoconductor drum that can be inserted in and pulled out from the apparatus main body, the photoconductor drum being formed in a cylindrical shape with its axial direction being identical with an insertion direction in which the photoconductor drum is inserted in the apparatus main body, the photoconductor drum facing the transfer surface of the transfer belt in an attachment state where the photoconductor drum is attached to the apparatus main body; and a transmission member attached to a drum end of the photoconductor drum on an insertion direction side and configured to transmit an input rotational driving force to the photoconductor drum, wherein the transmission member includes:

a flange being larger than the photoconductor drum in outer diameter; and a gear projecting from the flange in the insertion direction with teeth being formed on an outer circumferential surface of the gear, the teeth receiving the rotational driving force, the gear being larger than the photoconductor drum and smaller than the flange in outer diameter, and the flange is not in contact with a belt end portion of the transfer belt on the insertion direction side in the attachment state, and the flange comes into contact with the belt end portion during a process where the photoconductor drum is pulled out from the apparatus main body.

2. The image forming apparatus according to claim 1, wherein the flange includes an inclined surface that is inclined with respect to the belt end portion.

3. An image forming apparatus comprising:

a transfer belt provided in an apparatus main body and including a transfer surface on which a toner image is transferred;

a photoconductor drum that can be inserted in and pulled out from the apparatus main body, the photoconductor drum being formed in a cylindrical shape with its axial direction being identical with an insertion direction in which the photoconductor drum is inserted in the apparatus main body, the photoconductor drum facing the transfer surface of the transfer belt in an attachment state where the photoconductor drum is attached to the apparatus main body;

a transmission member attached to a drum end of the photoconductor drum on an insertion direction side and configured to transmit an input rotational driving force to the photoconductor drum, the transmission member including:

a flange being larger than the photoconductor drum in outer diameter; and a gear projecting from the flange in the insertion direction with teeth being formed on an outer circumferential surface of the gear, the teeth receiving the rotational driving force, the gear being larger than the photoconductor drum and smaller than the flange in outer diameter;

a developing roller rotatably supported so as to face an outer circumferential surface of the photoconductor drum with a predetermined interval therebetween; and an elastic member located more on the transfer belt side than the developing roller and configured not to be in contact with the flange in the attachment state and to come into contact with the flange during a process where the photoconductor drum is pulled out from the apparatus main body.

4. The image forming apparatus according to claim 3, wherein the elastic member is an elastic film member extending in an axial direction of the developing roller.

5. The image forming apparatus according to claim 3, wherein the elastic member has an inclined portion at its end on the insertion direction side, the inclined portion being configured to come into contact with the flange.

6. The image forming apparatus according to claim 3, wherein in the attachment state, the elastic member extends toward the photoconductor drum more than an end portion of the flange that extends in a radius direction of the flange.

7. The image forming apparatus according to claim 3, further comprising:

rotatable rolls that are respectively provided at opposite ends of the developing roller opposing in an axial direction of the developing roller, and keep the developing roller separate from the photoconductor drum by the predetermined interval while pressing opposite end portions of the outer circumferential surface of the photoconductor drum with a predetermined biasing force.

* * * * *